United States Patent [19]

Beach

[11] 4,092,893

[45] June 6, 1978

[54] MULTIPLE SELECTIVE BELL CONSOLE AND INSTRUMENT

[75] Inventor: Ronald O. Beach, Doylestown, Pa.

[73] Assignee: Schulmerich Carillons, Inc., Sellersville, Pa.

[21] Appl. No.: 736,405

[22] Filed: Oct. 28, 1976

[51] Int. Cl.[2] ..... G10H 3/00; G10F 1/08

[52] U.S. Cl. ..... 84/1.11; 84/1.01; 84/1.15; 84/103; 340/393

[58] Field of Search ..... 84/1.01, 1.03, 1.04, 84/106, 1.11, 1.14–1.16, 103; 340/392, 393

[56] References Cited

U.S. PATENT DOCUMENTS

| | | | |
|---|---|---|---|
| 2,180,122 | 11/1939 | Severy | 84/1.14 |
| 3,048,071 | 8/1962 | Kunz | 84/1.15 |

*Primary Examiner*—Edith S. Jackmon

*Attorney, Agent, or Firm*—Woodcock, Washburn, Kurtz & Mackiewicz

[57] ABSTRACT

A carillon keyboard instrument is provided for playing bells and auxiliary bell tones, with a pedal provided for allowing the player to adjust the relative intensities of the major and minor tones of the bells. The instrument utilizes two sets of vibrator bars, a first set for generating major tones, and a second set for generating minor tones. By mixing the derived signals from corresponding major and minor vibrator bars, and adjusting the relative intensity of the minor signal strength, a new flexibility is provided to the instrument player for generating desired Flemish bell tones.

14 Claims, 4 Drawing Figures

MULTIPLE SELECTIVE BELL CONSOLE AND INSTRUMENT

BACKGROUND OF THE INVENTION

1. Field of the Invention

This invention relates to carillon type tone generator instruments and, more particularly, to carillon keyboard instruments for providing automatic or operator controlled Flemish bell tones.

2. Description of the Prior Art

Various musical instruments have been built and available to the public over the years for playing bell or chime tones, such instruments being adapted particularly for uses in churches, university bell towers and the like. Conventionally, in such instruments the nature of the bell tone is essentially fixed in the instrument, such as the tone produced by the striking of a foundry-cast bell is fixed in its essential nature. In bell instruments and other types of electronic musical instruments, various techniques have been utilized to modify the tone, such as producing undulating sounds and the like, but such procedures do not alter the essential nature of the bell tone. The utilization of bars or rods, either solid or hollow, for the purpose of striking same and generating vibrations which are translated into electrical signals by suitable transducers, is known in the art of making bell or carillon type instruments. But again, the produced tones are essentially unalterable. The fundamental reason for this is that once the vibrator bar is produced and mounted, and a means for initiating vibration is likewise fixed in position, the essential nature of the resulting vibrations is fixed.

In the area of carillon type instruments, it is a primary aim to generate signals which are accurately representative of Flemish tuned bells. The Flemish tuned bell has a very distinct sound which is recognized immediately as being characteristic, or representative of a bell. The tuned bell, of traditional origin, does not produce a natural music tone, but rather a tone which contains partials which set it off as having a sound quite distinct from all other musical notes. The partials of the tuned bell were selected after much experimentation over the years in seeking a bell sound that would be pleasing in its harmonic and partial combinations. In particular, it is the combination of the individual partials produced in the vibration of the bell that gives the tuned bell its characteristic sound. Although the tuning of bells has long been carried out as an exacting art, there are still many harmonic combinations which are dissonant to listeners, and the tuning of carillon bells has long been controversial. Thus, it is the arrangement of the partials produced when a bell or vibrating bar is struck which gives the bell tone its characteristic sound. The relative strength of the minor partials and major partials, with the resulting dissonance, is a subjective matter with which carilloneurs have always and presumably always will have differences. To illustrate, strike tone C and E-natural form a major third interval, while strike tone C and its first partial E-flat form a minor third interval. A strong minor-second clash exists between E-natural and E-flat, because the minor third partial is very prominent. By reducing the "loudness", or strength, of the minor partial and increasing the loudness, or strength, of the major partial, a more consonant sound is produced. Conversely, reducing the loudness, or strength of the major partial, and increasing the loudness, or strength of the minor partial, produces a more dissonant sound. However, the presence of the minor partial is necessary for a bell to have its characteristic sound. The amount in relation to the major partial may vary, but both the major and minor partials are necessary for production of a bell tone. The prior art contains a great deal of descriptive literature concerning the partial and harmonic makeup of bell tones, and it is not intended in this specification to set forth those teachings. However, it is sufficient for an understanding of this invention to keep in mind that the term major partials, or simply majors, refers to a first combination of frequencies, whereas the term minor partials or minors refers to a second distinct combination, and that the desired bell tone for any one given bell sound is some combination of these two.

SUMMARY OF THE INVENTION

It is a primary object of this invention to provide an instrument for generating bell tones which gives the operator means to continuously adjust the contribution of major and minor partials to the generated bell tones.

It is a further object of this invention to provide means for optimizing a single rod as a generator for a plurality of respective tone sources.

It is another object of this invention to provide a keyboard carillon instrument with means for automatic carillon operation, the automatic means including means for selecting a pre-set mix of major and minor signals.

It is another object of this invention to provide an optimally efficient carillon instrument with which an operator can play a range of bell tones, the instrument having both a major keyboard for playing normal Flemish bell tones and a harp keyboard for playing harp type tones, and also having means for effective and continuous adjustment of the major and minor contributions to the Flemish bell tones generated.

In accordance with the above objectives, there is provided a keyboard instrument having two sets of vibrators, each vibrator set being designed to provide a predetermined range of tone octaves, the vibrators of the first set being adapted to generate either major partial signals or harp signals, and the vibrators of the second set being adapted to generate minor partial signals. Corresponding to each key on the major keyboard, there are two strikers positioned to strike a given one of the major/harp bars and a striker positioned to strike one of the minor bars. Corresponding to each key of the harp keyboard there is a third striker associated with each one of the major harp bars. Pickup means associated with each bar provide electrical signals, and mixer means are provided for mixing the composite pickup signals from the major/auxiliary bell set and the minor set. When playing the major/minor, or bell keyboard, a control means including a foot pedal are provided for continuous operator control of the relative contribution of the minor signal, whereby the major/minor composition of the bell tones can be readily operator controlled. For automatic operation, the foot pedal control is replaced with fixed circuit control which can be pre-set as desired.

DESCRIPTION OF THE PREFERRED EMBODIMENT

Figure 1:
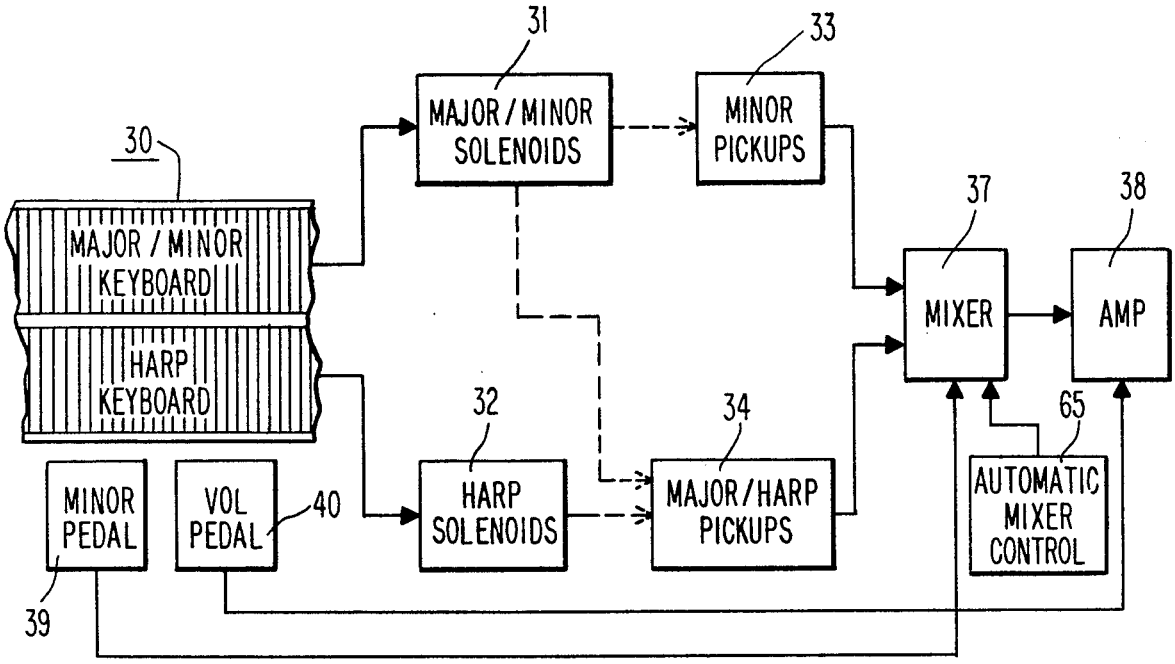
FIG. 1 is a block diagram representation of the electronic system for generating electrical signals representative of the bell and harp sounds as utilized in the instrument of this invention.

Referring to the drawings, FIG. 1 illustrates the overall means of producing the desired output tones produced by the instrument of this invention. A conventional keyboard console 30 is suitably provided having 2 keyboards designated as the major/minor keyboard and the auxiliary bell keyboard. The auxiliary bell keyboard is referred to in the drawings as the harp keyboard, reflecting the fact that in the preferred embodiment harp tones are produced. In the description and claims that follow, the terms "harp" and "auxiliary bell" are used interchangeably, it being understood that the term harp is not limiting but represents bell tones auxiliary to the characteristic bell tones.

In practice, the major/minor keyboard is suitably the upper keyboard, and is utilized for playing the bell tones. The auxiliary bell keyboard is suitably the lower keyboard, and is connected to play auxiliary bell tones. This is generally used as an accompanyment to the major/minor keyboard. Attached to the console, suitably at the floor thereof, is a minor pedal 39 and volume pedal 40, which are utilized by the operator in a manner described fully hereinbelow.

Figure 2:
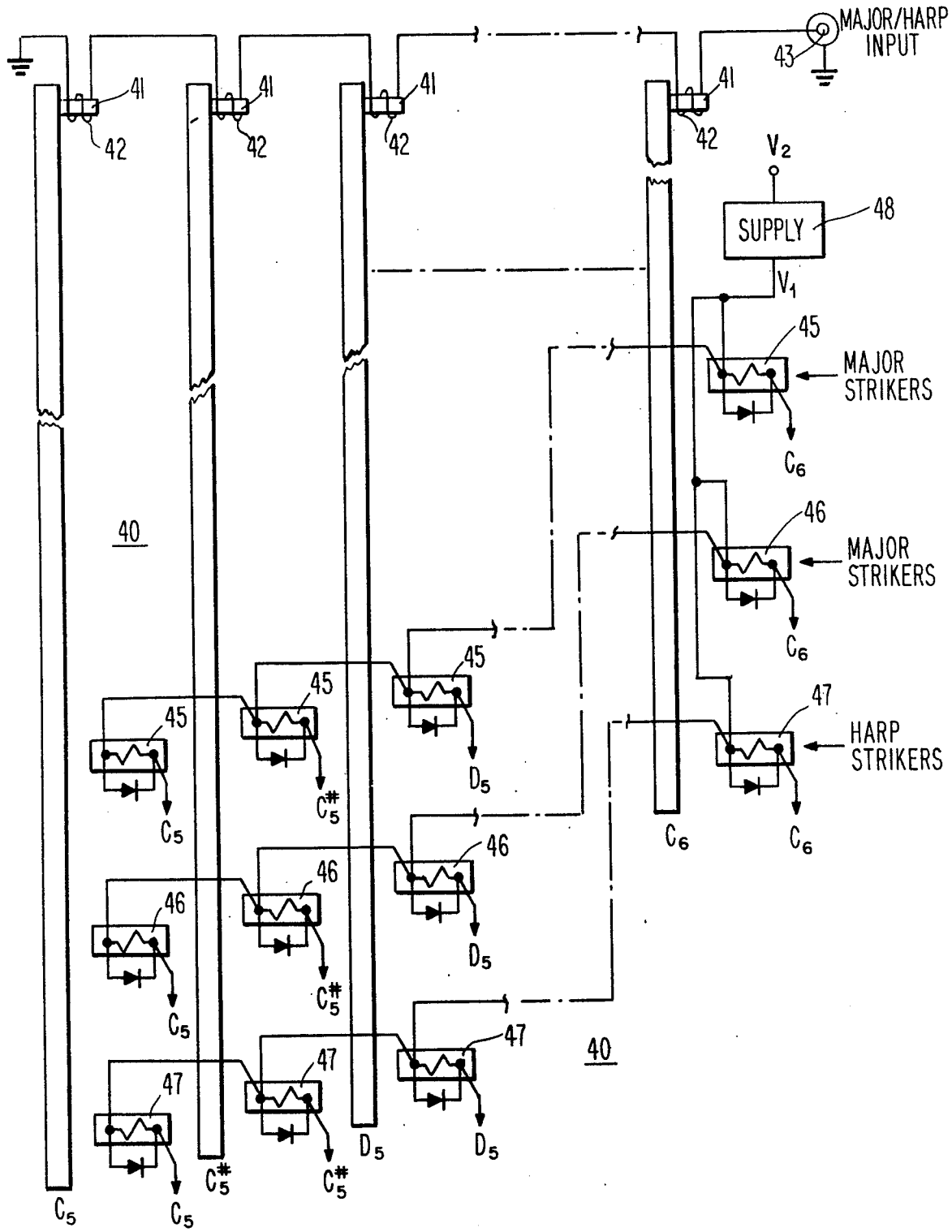
FIG. 2 is a schematic representation of a set of vibrators and accompanying strikers for producing major and harp signals.
Figure 3:
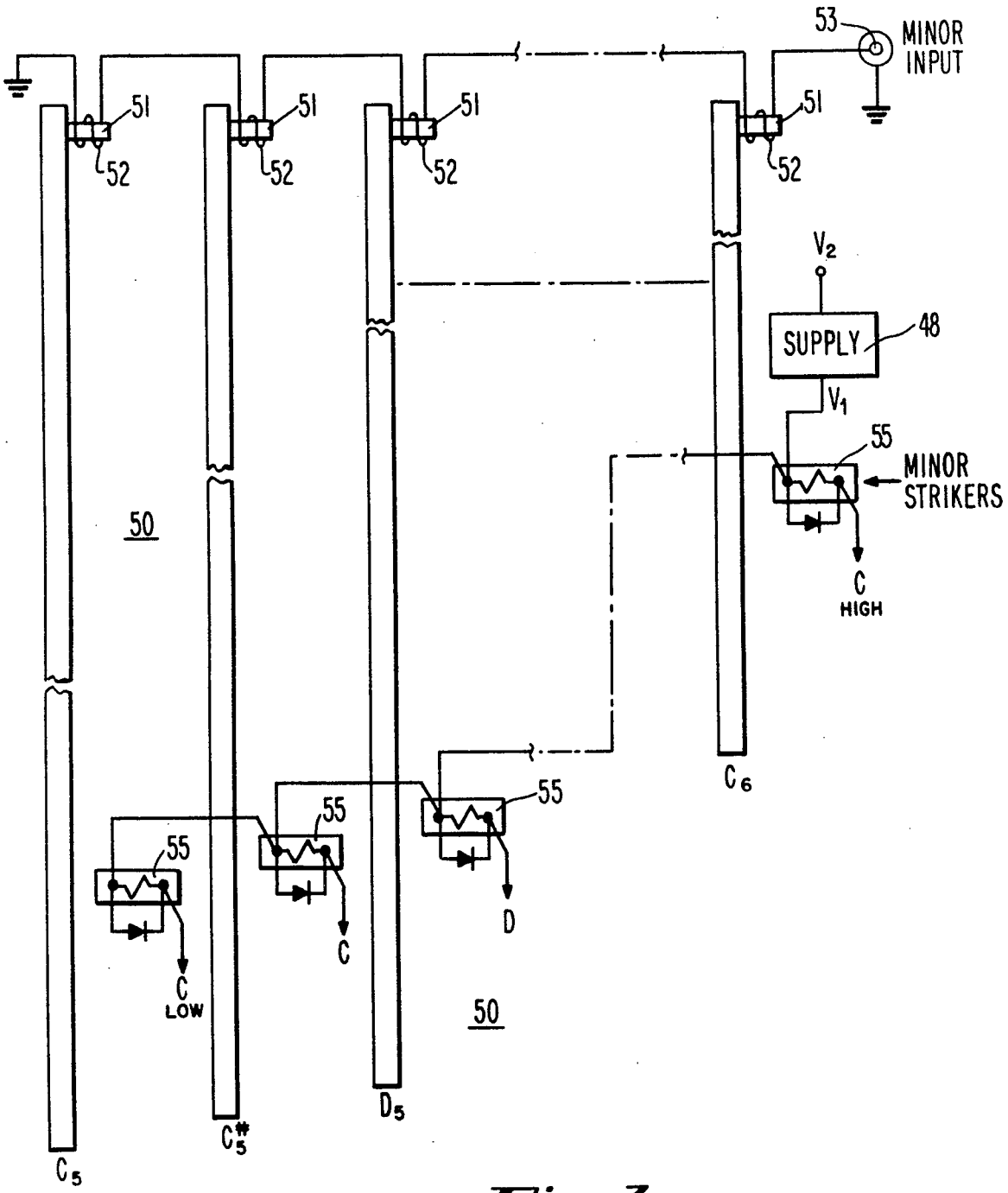
FIG. 3 is a schematic representation of a set of vibrators and accompanying strikers for producing minor tone representations.

Each key of the major/minor keyboard is switchably connected to respective different major and minor solenoids, the switch connection being closed upon playing of the key so that the connected solenoids are actuated in a manner described more fully in connection with the description of FIGS. 2 and 3. In the preferred embodiment of this invention, the playing of any single key on the major/minor keyboard actuates two major solenoids which cause the striking of a major bar to produce the major partials of the desired bell tone, and also actuates a minor solenoid to cause the striking of a corresponding minor bar, for production of the desired minor partials for the composite bell tone. Each of the two bars has associated therewith a magnetic pickup which generates an electrical signal representative of the physical vibrations of the struck bar. As seen in FIG. 1, pickups associated with the minor bar generators are shown in block 33, whereas the pickups associated with the major bar generators are shown in block 34. In FIG. 1 the bars themselves are not shown, as they are not a direct part of the electronic circuitry, but it is understood that they are acted upon by the solenoids 31, 32 and in turn act upon the pickups 33, 34.

When a key on the lower, or auxiliary bell keyboard is played, a single switch connection is made to a single solenoid positioned to cause the striking of a corresponding one of the set of bars utilized to generate the major partial tones, there being no corresponding minor tone generated simultaneously. The same pickups utilized for sensing of the major tones are utilized for sensing the harp, or auxiliary bell tones, as shown in block 34. The outputs of both blocks 33 and 34 are combined in a mixer 37, which produces at its output a combination of the two inputs which is adjusted as a function of the positioning of the minor pedal 39. It is to be noted that when the major/minor keyboard is being played, the output of mixer 37 is an operator adjustable combination of both the minor and major pickups, whereas when the harp keyboard is being played the mixer receives an input only from pickups 34. The output of the mixer is amplified as shown at block 38, with volume adjustment as provided through volume pedal 40 in a conventional manner. The output, of course, is then connected to suitable output transducers, i.e., speakers, for final production of the desired music in audio form.

In the automatic operation of the instrument of this invention, an automatic playing device is utilized instead of the keyboard 30, for activating solenoids 31, 32. In addition, control of the major/minor mix is provided automatically as shown at block 65, instead of through pedal 39.

Figure 4:
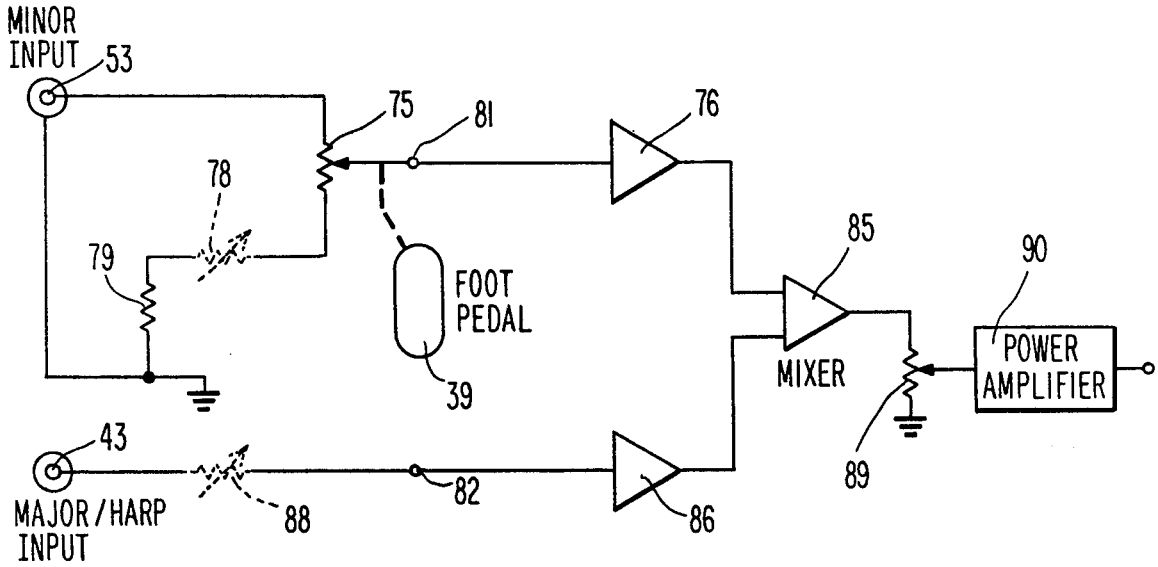
FIG. 4 is a circuit diagram of the circuit used in the instrument of this invention for combining the minor and major inputs to form a composite bell tone.

Reference is now made to FIGS. 2–4 for a more complete description of the structural components of the instrument of this invention. In FIG. 2 there is illustrated a set 40 of vibrator bars, or vibrators, each bar being a distinct tone source. The bars are suitably metallic in nature, although they may be made of other materials, including glass, and are fashioned so as to produce desired tone signals when struck by the major strikers 45, 46 or the harp striker 47. The exact composition and dimensions of each of the bars may be modified in accordance with techniques well known in the art, it being sufficient for the purposes of this specification that it be understood that each bar is designed to produce a separate characteristic tone. The illustration of FIG. 2 shows an octave of bars, going from the longest which is designated $C_5$ to the shortest which is designated as $C_6$. Only the $C_5$, $C_5$-Sharp, $D_5$ and $C_6$ bars are shown, it being understood that all of the other notes in the octave are also part of the set. In addition, it is to be understood that the set of major/harp bars comprises a plurality of octaves, only one octave being shown for purposes of illustration. Suitably, the instrument has a 61 note keyboard with a range of bells from $C_3$ to $C_8$, although only 37 tuned bells are typically utilized, corresponding to 3 octaves. The bars are free-free, being string mounted such that they are entirely freely suspended. Each bar has integrally connected thereto near one end a ferromagnetic element 41 which is positioned to interact with a magnetic pickup element 42, the magnetic pickup element 42 being adapted to generate an electrical signal corresponding to the physical vibrations of the bar when it is impacted by a striker.

Associated with each bar at respective different positions are two major strikers 45 and 46, and a harp striker 47. The two major strikers are positioned at respective different points along the bar so as to optimally produce the desired major partials corresponding to the tone to be produced when the associated bar is struck. It has been found that by striking the bar with two strikers, or hammers, positioned at two different locations relative to the length of the bar, an improved source of the major partials is obtained. Each striker 45, 46, 47 has associated therewith a solenoid which is switchably energized by supply 48. One terminal, designated $V_1$ of supply 48 is connected in common to one side of each of the solenoids of strikers 45, 46, 47 for each bar of the set. The other terminal of each of the 3 solenoids for each bar, which terminals are designated as $C_5$, $C_5$-Sharp, $D_5$, etc. and which are shown having an arrow connected thereto pointing away from the terminal, are connected to the $V_2$ supply terminal through a switch which is closed when the corresponding key on the major/minor keyboard is struck by the player. The strikers 47 are positioned so that when they are activated the hammer associated therewith strikes the bar in order to provide a harp tone corresponding to the desired note. The solenoid portions of strikers 47 are similarly activated when keys on the harp keyboard are played. Note that playing of a key on the major/minor keyboard causes the striking of a corresponding bar with a pair of hammers 45 and 46, without the bar being struck by striker 47. Although not shown in FIG. 2, there is suitably associated with each octave of the major/harp bars a variable resistor which is adjustable to fix the relative intensity of the pickup of the respective octaves, the respective octave pickups being combined in series to produce the total major/harp input at node 43.

Referring now to FIG. 3, there is illustrated a set of bars 50 which are similar in arrangement, and which correspond to the set 40. For each bar in set 40, there is a corresponding bar in set 50. For example, for the $C_5$ bar found in set 40 which produces the $C_5$ major partials, there is a corresponding $C_5$ bar in set 50 which produces the $C_5$ minor partials. The operation of ferromagnetic elements 51 and magnetic pickups 52, as well as strikers 55, is the same for set 50 as for elements 41, 42 and 45 in FIG. 2. It is to be noted that when a key on the major/minor keyboard is played, at the same time that the two corresponding major strikers 45, 46 are actuated, a corresponding striker 55 is actuated, so that the major partials and minor partials are generated simultaneously. When a key on the harp keyboard is played, no striker 55 is actuated. The minor pickup elements 52 are connected in series, and in a similar fashion as described for the major/harp pickups, there is suitably a variable resistor for adjusting the relative pickup intensity for each octave. The summation of the composite minor pickups is presented between node 53, designated as minor input, and ground.

Referring now to FIG. 4, there is shown a circuit diagram illustrating the manner in which the two inputs, minor and major/harp, are combined and processed to produce the final desired tone. The minor inputs, at node 53, is connected through variable resistance 75 and fixed resistance 79 to ground. Variable resistance 75 may be, for example a 50,000 ohm potentiometer which is positioned by activation of the foot pedal 39. In practice, when the foot pedal is in the vertical, or heel position, the volume of the minor partials is maximized relative to the major partials, while when the pedal is in the horizontal or toe position, the volume of the major partials is maximized with respect to the minor partials. When the pedal is completely in the horizontal or toe position the volume of the major partials is at its highest level, and the volume of the minor partials is at the lowest level. Resistor 79 is suitably a **51*k* resistor. Additionally, adjustable resistor 78 may be utilized, which may be set by the operator, as through a switch on the console, for limiting the range of adjustment provided by potentiometer 75. The output of potentiometer 75 is processed through minor preamplifier 76 and inputted as one of the two inputs to mixer 85. The major/harp input, at node 43, is processed through major/harp preamplifier 86, the output of which is connected as a second input to mixer 85. The major/harp path may also suitably contain a manually adjustable potentiometer 88, which may be set by a switching means the same as potentiometer 78, to provide the operator with means for fixing the setting of the major/harp signal. The output of the mixer is suitably connected through variable potentiometer 89, which may be connected to volume pedal 40, to power amplifier 90. The output of amplifier 90** is connected to suitable speakers for final production of the desired notes.

In an alternate embodiment, the same circuitry as shown in FIG. 4 between nodes 53 and 81 is utilized between nodes 43 and 82, with the foot pedal linkage being arranged to simultaneously increase and decrease the respective signals produced at nodes 81 and 82. When the foot pedal is in the heel position, the volume of the minor partials is at its maximum level, and the volume of the major partials is at its minimum level. As the pedal is moved to the horizontal, or toe position, the minor partial volume is gradually lessened and the major partial volume is gradually increased. When the pedal is completely in the horizontal position the volume of the major partials is maximized and that of the minor partials is minimized.

For automatic carillon operation, automatic pre-set control of the major/minor mix is utilized. In this mode of operation, the circuitry between nodes 53 and 81, and/or 43 and 82, is replaced with separate adjustable resistances permitting setting of the desired mix prior to automatic playing.

In operation, it is seen that the player of the instrument of this invention has continuous control through pedal 39 of the major/minor composition of the bell tones which are produced. By producing the major and minor partials through corresponding different vibrator bars, the relative contribution of each to the desired bell tone may be simply but effectively varied to the satisfaction of the player. Efficiency of construction is achieved by utilizing a plurality of strikers in association with the major/harp bars. It is noted that the use of two major strikers for production of the desired major partials achieves very excellent results. At the same time, the harp strikers are utilized with the same bars to produce the harp, or auxiliary bell tones. The positioning of three strikers at different points on the bar, two of which combine for the major tone, and having a single fixed position pickup, has been found to permit efficient construction and very excellent tone generation.

It is to be understood that various state of the art modifications and additions can be made to the instrument of this disclosure, all within the scope of the invention as claimed. For example, the composite pickup signals as shown produced at terminals 43 and 53 may be processed or conditioned in any desired way prior to being mixed. In the reduction to practice of this invention, many additional features may be incorporated into the instrument, which features are optical and a matter of design choice, and the inclusion or exclusion of such features does not alter or limit the scope of the invention is claimed hereinbelow.

I claim:

1. A carillon tone generator adapted for producing representations of a plurality of bell notes, comprising:

a. a first set of vibrators, each vibrator of said first set having a respective different characteristic;

b. first striker means positioned in operative relation to said first set of vibrators for controllably striking said first set vibrators to produce vibrations corresponding to respective tones, said first striker means comprising at least a first striker located in relation to each first set vibrator so as to cause said first set vibrator to produce a major tone when struck thereby and a second harp striker located at a respective different position relative to each of said first set vibrators so as to cause said first set vibrator to produce a harp tone when struck thereby;

c. first pickup means operatively associated with said first set of vibrators, for picking up a composite signal representative of the vibrations of said first set vibrators, said first pickup means comprising a transducer mounted in fixed operative relation with each of said first set vibrators;

d. a second set of vibrators, each vibrator of said second set having a respective minor characteristic, and said second set having a vibrator corresponding to each vibrator of said first set;

e. second striker means located in association with said second set of vibrators for controllably striking said second set vibrators, said second striker means comprising a striker positioned relative to each second set vibrator so as to cause said second set vibrator to produce a distinct minor tone when struck;

f. second pickup means operatively associated with said second set of vibrators for picking up a composite signal representative of the vibrations of said second set vibrators, said second pickup means comprising a transducer mounted in fixed operative relation with each of said second set vibrators;

g. means for selectively activating said first and second striker means, said activating means comprising control means for simultaneously activating corresponding strikers of said first and second sets;

h. mixer means connected to receive a major input from said first pickup means and a minor input from said second pickup means, for producing a mixed signal representative of a combination of said two inputs;

i. minor control means, in operative connection with said mixer means, for controlling the mixing operation of said mixer means; and j. means for amplifying and transducing the output of said mixer means, thereby to provide a bell tone output.

2. The instrument as described in claim 1, wherein said first set of vibrators and said first striker means are adapted for generation of major partial signals, and said second set of vibrators and said second striker means are adapted for generation of minor partial signals.

3. The instrument as described in claim 2, wherein said first striker means comprises two major strikers at respective different positions relative to each vibrator, and said activating means comprises means for activating each of said two major strikers simultaneously.

4. The instrument as described in claim 3, wherein said first striker means comprises a harp striker in operative relation with each of the vibrators of said first set, and said activating means comprises means for activating any one of said harp strikers exclusively of said two major strikers.

5. The instrument as set forth in claim 1, wherein said activating means comprises two keyboards, a first of said two keyboards having a plurality of keys each of which is in switchable connection with one of said each two major hammers and a corresponding minor hammer, and said second keyboard has a plurality of keys, each of which is in switchable connection with a respective one of said harp strikers.

6. The instrument as set forth in claim 1, wherein said instrument is housed in a console, and said minor control means comprises a foot pedal mounted on said console for operator control of the relative volume of said major and minor inputs.

7. The instrument as described in claim 1, comprising control adjustment means having means for providing a fixed initial setting of said minor control means.

8. The instrument as described in claim 7, wherein said control adjustment means comprises means for modifying the major input to said mixer means.

9. A tone generator for producing a signal representative of a bell tone, comprising:

a. a first vibrator bar in combination with two strikers, each of said strikers being positioned to strike said first bar at separate points thereon, and a first transducer in fixed operative relation to said first bar for generating a first electrical signal representative of the vibrations of said first bar when struck, whereby to produce the major partials of a bell tone;

b. a second vibrator bar in combination with a single striker positioned to strike said second bar, and a second transducer in fixed operative relation to said second bar for generating a second electrical signal representative of said second bar when struck, whereby to produce the minor partials of said bell tone;

c. activating means for simultaneously activating said two strikers and said single striker; and d. means for combining said first and second signals to produce said bell tone.

10. The tone generator as described in claim 9, wherein said combining means comprises means for varying the relative strengths of said first and second signals.

11. The tone generator as described in claim 10, wherein said combining means comprises means adapted for manual operation for varying the strength of said second signal.

12. The tone generator as described in claim 9, wherein said first and second bars from a first major/minor pair corresponding to a first bell tone, and further comprising a plurality of like bar pairs with like strikers, each such like bar pair being adapted to produce a respective different bell tone, said activating means comprising means for separately activating the strikers in combination with respective bars, and said combining means comprising means for deriving a composite first signal from said first transducers and a composite second signal from said second transducers.

13. The instrument as described in claim 1, wherein said selectively activating means comprises a keyboard and said minor control means has a control element adapted for operator control.

14. The instrument as described in claim 1, wherein said selectively activating means comprises automatic means for playing the instrument, and said minor control means comprises means for pre-setting the major/minor mix of the instrument.

* * * * *